US006118058A

United States Patent [19]

Rowley

[11] Patent Number: 6,118,058

[45] Date of Patent: Sep. 12, 2000

[54] MUSICAL INSTRUMENT PICK HAVING FINGER ATTACHMENT MEANS

[76] Inventor: Peter Rowley, 1926 E. La Veta, #114, Orange, Calif. 92866

[21] Appl. No.: 09/277,027

[22] Filed: Mar. 25, 1999

[51] Int. Cl.[7] ..... G10D 3/16

[52] U.S. Cl. ..... 84/320; 84/321; 84/322

[58] Field of Search ..... 84/320, 321, 322

[56] References Cited

U.S. PATENT DOCUMENTS

| | | | |
|---|---|---|---|
| 5,209,090 | 5/1993 | Stillwagon | 70/456 |
| 5,594,189 | 1/1997 | Latteri | 84/322 |
| 5,905,217 | 5/1999 | Byers | 84/322 |

OTHER PUBLICATIONS

Ring Pick Hang Tag.

*Primary Examiner*—Brian Sircus
*Assistant Examiner*—Kim Lockett
*Attorney, Agent, or Firm*—Roy A. Ekstrand

[57] ABSTRACT

An instrument pick and finger attachment includes a finger ring for wearing upon a user's finger together with a generally planar pick for strumming a stringed instrument. The pick is joined to the finger ring by a flexible chain via a pair of separable couplers at each end. The separable couplers facilitate the replacement or substitution of different components within the combination.

4 Claims, 2 Drawing Sheets

FIG. 2
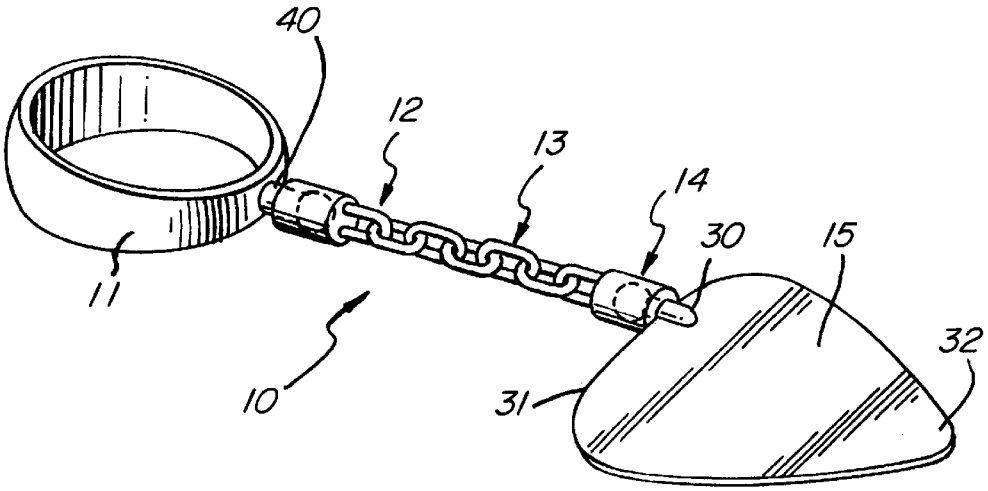
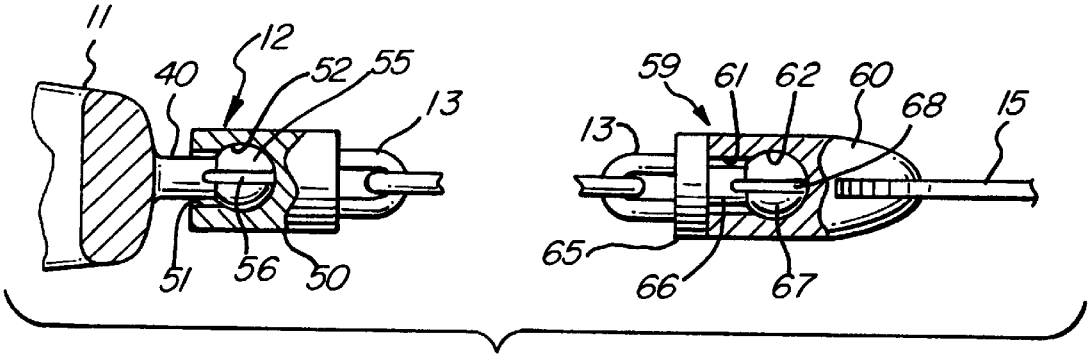
FIG. 3
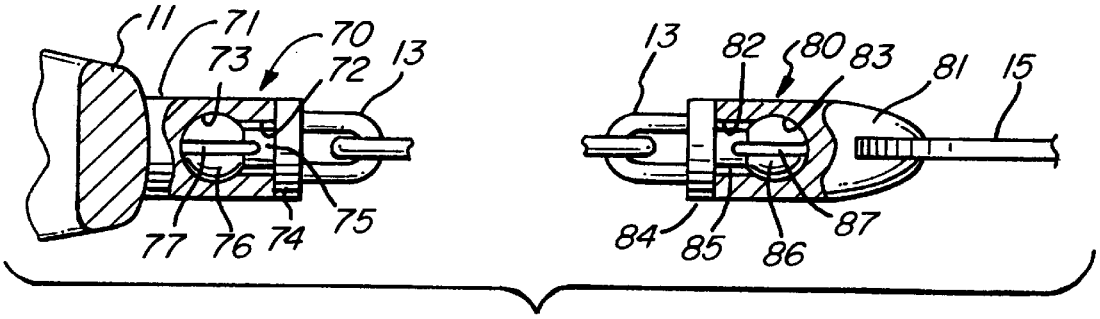
FIG. 4

MUSICAL INSTRUMENT PICK HAVING FINGER ATTACHMENT MEANS

FIELD OF THE INVENTION

This invention relates generally to string type musical instruments and particularly to the instrument pick device used in playing such instruments.

BACKGROUND OF THE INVENTION

A number of stringed instruments developed through history have played by "picking" or strumming" the instrument strings to produce the desired musical sounds. For example, musical instruments in general use today such as guitars, mandolins or the like employ a number of tightly tensioned strings which are formed of various materials and which are pulled to precise tensions to achieve the desired range of musical note vibratory frequencies.

While some musicians in playing such stringed instruments utilize their fingers or thumbs to pick or strum the instrument strings, by far the most common style of playing such instruments involves the use of a device generally known as a "pick" to play the instrument. In essence, the pick is used by the musician to either pluck or strum across one or more strings to induce vibration of the string which results in musical sound. Through the years, variously shaped pick devices have appeared and some variation persists. However, by far the most common type of pick is that generally referred to a guitar pick which defines a substantially thin planar member having a generally triangular shape with rounded corners. Such picks are made of different materials which range from inexpensive plastic to highly exotic and valuable precious metal in accordance with the user's preference.

Because the task of holding the pick while energetically playing a stringed instrument is often difficult, various aids for string instrument musicians have been devised. For example, U.S. Pat. No. 4,137,814 issued to Rowley sets forth a NONSLIP GUITAR PICK having a palm piece attached to a pick by means of a flexible connection whereby the palm piece and flexible connection cooperate to prevent the guitar pick from rotating in the user's grasp or slipping entirely from the user's hand.

A similar device manufactured and sold by Stonefeather Industries under the trademark "Ringpick" provides a finger ring and guitar pick coupled by a flexible chain. In use, the musician wears the finger ring upon the desired finger and holds the guitar pick between the thumb and forefinger with the flexible chain stretched therebetween.

U.S. Pat. No. 557,293 issued to Wahl sets forth a HOLDER FOR MANDOLIN PICKS having a finger ring supporting an extending beam element which in turn supports a flexibly mounted mandolin pick. In use, the musician secures the ring to a convenient portion of the musician's finger and grasps the flexibly mounted mandolin with the fingers and thumb of the musician's hand.

While the foregoing described prior art devices have provided some assistance in aiding musicians playing stringed instruments, they are subject to several limitations and problems. For example, it is commonplace for most picks to break after some use and musicians generally prefer to carry a backup pick in order to continue playing. Because the above-described prior art devices are somewhat costly and cumbersome, they discourage the practice of carrying extra picks thereby limiting the musician's security. In addition, the prior art devices fail to recognize that the frequently breaking pick portion of their various combinations is usually the least expensive portion of the apparatus. As a result, a somewhat costly device provided by such prior art structures must be replaced in its entirety as a result of the small inexpensive component of the pick having broken. This greatly increases the cost to the user.

There arises, therefore, a continuing and unfulfilled need in the art for an improved musical instrument pick which provides the convenience and use of chain-supported or tethered picks while overcoming the cost and practical disadvantages associated with the prior art devices.

SUMMARY OF THE INVENTION

Accordingly, it is a general object of the present invention to provide an improved musical instrument pick. It is a more particular object of the present invention to provide an improved musical instrument pick having finger attachment means which readily accommodate the breaking and replacement of the pick portion of the combination structure. It is a further object of the present invention to provide an improved musical instrument pick having finger attachment means which facilitates the interchange of different finger attachment rings and picks as the user desires.

In accordance with the present invention, there is provided a musical instrument pick and finger attachment for use in playing a stringed musical instrument, the musical instrument pick and finger attachment comprising: a finger ring defining a finger-receiving aperture therethrough; a pick defining a generally planar portion; a flexible chain having first and second ends; a first coupler having first cooperating members for separable engagement joining the first end to the finger ring; and a second coupler having second cooperating members for separable engagement joining the second end to the pick.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2 sets forth a perspective view of the present invention musical instrument pick and its finger attachment means; and FIG. 3 sets forth a partial section view of the coupling mechanisms used in the present invention musical instrument pick;

FIG. 4 sets forth an alternate combination of coupling mechanisms for the present invention musical instrument pick;

DESCRIPTION OF THE PREFERRED EMBODIMENTS

Figure 1:
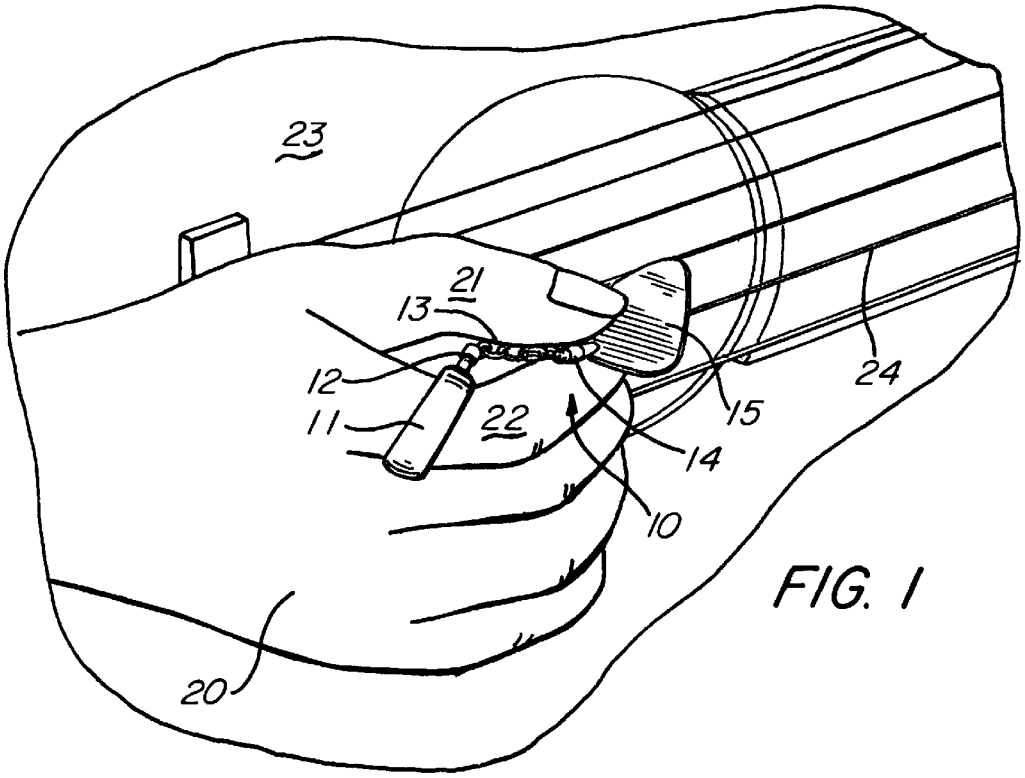
FIG. 1 sets forth a perspective view of a musical instrument pick constructed in accordance with the present invention in a typical handheld use upon a typical stringed instrument.

FIG. 1 sets forth a perspective view of a musical instrument pick and finger attachment apparatus constructed in accordance with the present invention and generally referenced by numeral 10. Instrument pick and finger attachment 10 is shown secured to a musician's hand generally referenced by numeral 20. Hand 20 is positioned in a standard playing posture with respect to a conventional guitar 23 having a plurality of tensioned strings 24. Hand 20 includes a thumb 21 and forefinger 22 positioned in a standard hand position for musical play.

In accordance with the present invention, instrument pick and finger attachment 10 includes a generally annular finger ring 11 received upon forefinger 22 and a generally planar pointed pick 15. The latter is held between thumb 21 and forefinger 22 for musical play. In further accordance with the present invention, a chain 13 joins pick 51 to finger ring 11 using a pair of couplers 12 and 14. The structure of couplers 12 and 14 is set forth below in greater detail. However, suffice it to note that, in accordance with an important aspect of the present invention, couplers 12 and 14 are detachable fastening couplers and thus finger ring 11 may be separated from chain 13 as desired by simply uncoupling coupler 12. Similarly, and in further accordance with an important aspect of the present invention, coupler 14 provides a similar removable coupling by which pick 15 may be separated from chain 13. Thus, by provision of couplers 12 and 14 on each end of chain 13, the flexible attachment between finger ring 11 and pick 15 is readily provided together with the further advantage of easy separation between chain 13 and either finger ring 11 or pick 15. This facilitates replacing a broken pick in place of pick 15 by simply uncoupling coupler 14 and replacing pick 15 utilizing a similar coupling element. In a similar advantage, coupler 12 allows the replacement of finger ring 11 with a different or alternative finger ring in order to accommodate use on different fingers or different finger sizes between players having need to use instrument pick and finger attachment 10. The interchangability of pick 15 and finger ring 11 utilizing couplers 12 and 14 greatly increases the flexibility and practicality of the instrument pick and finger attachment of the present invention. It will be recalled that in most instances pick 15 is fabricated of a relatively low cost, thin plastic material which tends to break from time to time during use. Utilizing the present invention, coupler 14 allows pick 15 to be readily replaced. In addition, pick 15 may be replaced for other reasons such as player preference for a differently shaped or differently fabricated pick once again using coupler 14.

It will be noted that while FIG. 1 shows finger ring 11 upon the user's forefinger or index finger, finger ring 11 may be placed on any of the user's fingers in accordance with preference. In accordance with the present invention, couplers 12 and 14 also facilitate the replacement of chain 13 with a similarly configured chain to provide interchangeable flexible chains for purposes such as replacing a defective or broken chain or providing chains of different lengths as needed.

Thus, instrument pick and finger attachment 10 allow the user to securely hold pick 15 during the typical musical play activities and to retain pick 15 in convenient attachment to finger ring 11 during other times of nonuse. Because each element within the combination of instrument pick and finger attachment 10 is replaceable, a variety of finger rings, coupling chains, and picks may be interchangeably used through the application of couplers 12 and 14.

FIG. 2 sets forth a perspective view of instrument pick and finger attachment 10 fully assembled. Thus, as described above, instrument pick and finger attachment 10 includes an annular finger ring 11 having a finger attachment 40 secured to a coupler 12. A chain 13 formed of interlocking metal links provides a flexible chain coupling between coupler 12 and a similar coupler 14. An attachment 30 cooperates with coupler 14 and is secured to pick 15 utilizing conventional fabrication techniques such as set forth below in greater detail. Pick 15 is fabricated of a generally planar material and may, for example, be fabricated of a low cost plastic material or, alternatively, virtually any suitably rigid material including precious metals or the like. Pick 15 defines a rear edge 31 which receives attachment 30 and a frontal point 32 which is formed to provide the picking and strumming action of a stringed musical instrument. Once again, in accordance with an important aspect of the present invention, the removable attachment provided by coupler 12 between chain 13 and finger ring 11 allows interchangability of different finger rings having suitable attachment such as attachment 40. In further accordance with the present invention and as is also mentioned above, the cooperation of attachment 30 and coupler 14 provides a removable attachment for interchange of different picks for pick 15. Finally, the provision of couplers 12 and 14 on each end of chain 13 allow the combination of couplers 12 and 14 together with chain 13 to be removed from finger ring 11 and pick 15 to replace chain 13 as desired.

Figure 5:
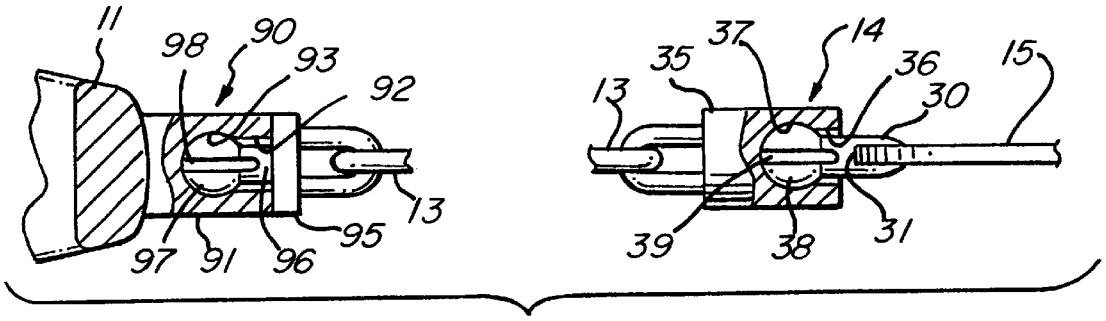
FIG. 5 sets forth a still further alternate combination of coupling mechanisms used in the present invention musical instrument pick.

FIGS. 3, 4 and 5 set forth partial section views of alternative combinations of couplers used in the above-described structure and provide examples of different coupler combinations all of which fall within the spirit and scope of the present invention. It will be recognized that the general coupling structure utilized in the apparatus shown in FIGS. 3, 4 and 5 is basically the same with the differences between the embodiments shown being found in the orientation of the couplers. Thus, for example in FIG. 3, chain 13 supports a female coupler at one end and a male coupler at the opposite end. In contrast, FIG. 4 provides male coupling elements on each end of chain 13 with cooperating female elements on finger ring 11 and pick 15. Finally, FIG. 5 sets forth the use of a male element on the finger ring coupling end of chain 13 and a female element on the pick end of chain 13.

More specifically, FIG. 3 sets forth a partial section view of the present invention instrument pick and finger attachment. Ring 11 includes an attachment 40 which supports a male coupler portion 55 having a slot 56 formed therein. Coupler 12 is secured to chain 13 and defines a female member 50 defining a passage 51 and a recess 55 therein. The coupling of coupler 12 is accomplished by forcing spherical male portion 55 through passage 51. Spherical male member 55 is able to deform during insertion through passage 51 due to slot 56. Thereafter, the resilient material of male member 55 allows it to expand within spherical recess 52 of female member 50. As a result, ring 11 is secured to chain 13 by coupler 12 in a removable attachment. Ring 11 is separated by simply drawing ring 11 and attachment 40 outwardly pulling male member 55 outwardly through passage 51 and separating coupler 12.

Pick 15 is secured to female portion 60 of a removable coupler 59 in the embodiment of FIG. 3. Coupler 59 is somewhat similar to coupler 12 in that female portion 60 defines a passage 61 and an interior generally spherical recess 62. Chain 13 is secured to a collar 65 which in turn supports a post 66 having a generally spherical male member 67 supported on the end thereof. As with coupler 12 described above, male member 67 defines a slot 68 which facilitates the insertion of male member 67 through passage 61 into recess 62. Once again, the attachment of coupler 59 is removable in that chain 13 is drawn away from female portion 60 pulling post 66 and male member 67 outwardly through passage 61. As a result, pick 15 which is secured to female portion 60 of coupler 59 is removable or detachable from chain 13.

FIG. 4 sets forth a partial section view of a similar coupling set. Ring 11 is secured to a female member 71 of a coupler 70 which defines an interior passage 72 and a spherical recess 73. Chain 13 is secured to a collar 74 which supports a post 75 which in turn supports a spherical male member 76 having a slot 77 formed therein. Thus, coupler 70 is joined by the insertion of spherical member 76 through passage 72 into recess 73 as described above to provide a separable coupler securing chain 13 to ring 11.

Pick 15 is secured to a female member 81 of a coupler 80 which defines an interior passage 82 and a spherical recess 83 therein. Chain 13 is secured to a collar 84 which supports a post 85 which in turn supports a spherical male member 86 having a slot 87 defined therein. Once again, coupler 80 is separable to allow chain 13 and pick 15 to be separated.

FIG. 5 sets forth a similar partially sectioned view of an alternate coupler set for use in instrument pick and finger attachment 10. Ring 11 is secured to a female member 91 of a coupler 90 having a passage 92 and recess 93 formed therein. Chain 13 is secured to a collar 95 which supports a post 96 which in turn supports a spherical male member 97 having a slot 98 formed therein. The operation of coupler 90 is substantially identical to the operation set forth above and facilitates the separable coupling of chain 13 to ring 11.

Pick 15 is, as described above, secured to an attachment 30 of coupler 14. Attachment 30 supports a spherical male member 38 having a slot 39 formed therein. Coupler 14 is completed by a female member 35 having a passage 36 and spherical recess 37 formed therein. Member 35 is joined to chain 13 to facilitate the separable coupling between pick 15 and chain 13 in the manner described above.

Thus, it will be apparent to those skilled in the art from examination of FIGS. 2 through 5 that a variety of different coupler combinations may be utilized in the present invention to provide an instrument pick and finger attachment in accordance with the invention which facilitates separation of the pick, chain and ring portions for repair, replacement and interchangability.

Figure 6:
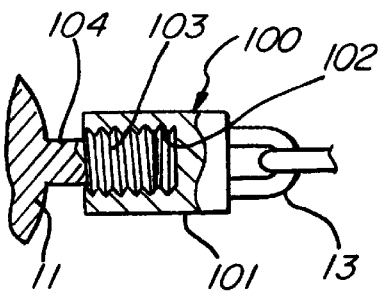
FIG. 6 sets forth a partial section view of an alternative coupler used in the present invention musical instrument pick.
Figure 7:
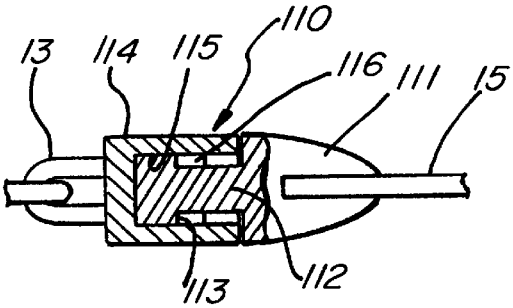
FIG. 7 sets forth a partial section view of a still further alternate coupling mechanism used in the present invention musical instrument pick.

FIGS. 6 and 7 set forth partial section view of exemplary alternative couplers. It should be noted that the present invention is not dependent upon any particular type of separable coupler between chain 13 and finger ring 11 and pick 15. Accordingly, alternative embodiments are shown in FIGS. 6 and 7.

More specifically, FIG. 6 sets forth a partial section view of a threaded coupler which may be used to replace any of the couplers set forth above such as couplers 12 or 14 in FIG. 2. Thus, the coupler of FIG. 6 generally referenced by numeral 100 includes a female member 101 secured to chain 13 having a threaded passage 102 formed therein. Correspondingly, coupler 100 is completed by a post 104 supporting a threaded element 103 which is secured to ring 11. The threaded engagement of threaded member 103 within passage 102 removably secures coupler 100 attaching ring 11 to chain 13.

FIG. 7 sets forth a partial section view of a further alternate embodiment of the present invention using a conventional bayonet-type coupler in which the male member is inserted into and rotated within a passage defined within the female member. More specifically, coupler 110 includes an attachment 111 securing a male member 112 to pick 15. Male member 112 defines a pair of outwardly extending tabs 113. Coupler 110 is completed by a female member 114 joined to chain 13 and defining an interior passage 115. Passage 115 defines bayonet tab receiving grooves 116 which provide the insertion and rotate to lock function of bayonet connector 110.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A musical instrument pick and finger attachment for use in playing a stringed musical instrument, said musical instrument pick and finger attachment comprising:

a finger ring defining a finger-receiving aperture therethrough;

a pick defining a generally planar portion;

a flexible chain formed of a plurality of interlocking links and having first and second ends;

a first coupler having first cooperating members including first male and female coupler members for separable engagement joining said first end to said finger ring; and a second coupler having second cooperating members including second male and female coupler members for separable engagement joining said second end to said pick, said first and second female members each defining an interior passage and recess and said first and second male members each defining a post and expandable male portion received within said interior passage and recess.

2. A musical instrument pick and finger attachment for use in playing a stringed musical instrument, said musical instrument pick and finger attachment comprising:

a finger ring defining a finger-receiving aperture therethrough;

a pick defining a generally planar portion;

a flexible chain formed of a plurality of interlocking links and having first and second ends;

a first coupler having first cooperating members including first male and female coupler members for separable engagement joining said first end to said finger ring; and a second coupler having second cooperating members including second male and female coupler members for separable engagement joining said second end to said pick, at least one of said first and second couplers including a female member defining a threaded passage and a male member defining a threaded shaft.

3. A musical instrument pick and finger attachment for use in playing a stringed musical instrument, said musical instrument pick and finger attachment comprising:

a finger ring;

a generally planar pick;

an elongated chain having a plurality of interlocking links and first and second ends; and first and second couplers having first and second cooperating members including respective first and second male and female coupling members for separable engagement joining said first end to said finger ring, said first said second female members each defining an interior passage and recess and said first and second male members each defining a post and expandable male portion received within said interior passage and recess.

4. A musical instrument pick and finger attachment for use in playing a stringed musical instrument, said musical instrument pick and finger attachment comprising:

a finger ring;

a generally planar pick;

an elongated chain having a plurality of interlocking links and first and second ends; and first and second couplers having first and second cooperating members including respective first and second male and female coupling members for separable engagement joining said first end to said finger ring, at least one of said first and second couplers including a female member defining a threaded passage and a male member defining a threaded shaft.

* * * * *